US009639044B2

(12) United States Patent
Hayashi et al.

(10) Patent No.: US 9,639,044 B2
(45) Date of Patent: May 2, 2017

(54) FIXING DEVICE THAT RESTRAINS DAMAGE OF BELT MEMBER AND IMAGE FORMING APPARATUS INCLUDING THE SAME

(71) Applicant: KYOCERA Document Solutions Inc., Osaka (JP)

(72) Inventors: Eriko Hayashi, Osaka (JP); Yoshiharu Kanematsu, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/160,552

(22) Filed: May 20, 2016

(65) Prior Publication Data

US 2016/0363896 A1 Dec. 15, 2016

(30) Foreign Application Priority Data

Jun. 12, 2015 (JP) ..... 2015-119463

(51) Int. Cl.
*G03G 15/20* (2006.01)

(52) U.S. Cl.
CPC ..... *G03G 15/2057* (2013.01)

(58) Field of Classification Search
CPC ..... G03G 15/2057; G03G 15/2017; G03G 15/2053
See application file for complete search history.

(56) References Cited

U.S. PATENT DOCUMENTS

2011/0211881 A1* 9/2011 Suzuki ..... G03G 15/2053 399/329
2014/0301760 A1* 10/2014 Nanjo ..... G03G 15/2085 399/329
2016/0179043 A1* 6/2016 Kawaguchi ..... G03G 15/2053 399/329

FOREIGN PATENT DOCUMENTS

JP 2002-231419 A 8/2002

* cited by examiner

*Primary Examiner* — Rodney Bonnette
(74) *Attorney, Agent, or Firm* — Stein IP, LLC

(57) ABSTRACT

A fixing device includes a housing, a belt member, a pressure roller, a nip forming member, and a pressing member. The belt member is constituted of a flexible tubular shape. The nip forming member is located at an inner peripheral portion of the belt member. The nip forming member has an opposed surface along an outer peripheral surface of the pressure roller. The nip forming member presses the belt member to the pressure roller. An end portion of the outer peripheral surface of the pressure roller is located inside with respect to an end portion of the belt member. The fixing device includes a pressing member located opposed to the pressure roller in the axial direction. The pressing member presses an outer peripheral surface of the end portion of the belt member in the axial direction to radially inward of the belt member.

8 Claims, 13 Drawing Sheets

FIXING DEVICE THAT RESTRAINS DAMAGE OF BELT MEMBER AND IMAGE FORMING APPARATUS INCLUDING THE SAME

INCORPORATION BY REFERENCE

This application is based upon, and claims the benefit of priority from, corresponding Japanese Patent Application No. 2015-119463 filed in the Japan Patent Office on Jun. 12, 2015, the entire contents of which are incorporated herein by reference.

BACKGROUND

Unless otherwise indicated herein, the description in this section is not prior art to the claims in this application and is not admitted to be prior art by inclusion in this section.

As a typical fixing device that performs a fixing process on a sheet, the following technique has been known. The fixing device includes a cylindrical-shaped belt member (a sleeve) and a pressure roller. A contact of the pressure roller with the sleeve forms a fixing nip portion between both. When the sheet passes through the fixing nip portion, a fixing process is performed on a toner image formed on the sheet. On the end portions of the sleeve in the axial direction, flanges, which hold the outer peripheral portion of the belt member, are mounted.

SUMMARY

A fixing device according to one aspect of the disclosure includes a housing, a belt member, a pressure roller, a nip forming member, and a pressing member. The belt member is constituted of a flexible tubular shape. The pressure roller is rotated and pressed by the belt member. The pressure roller forms a fixing nip portion with the belt member. A sheet passes through the fixing nip portion. The nip forming member is located at an inner peripheral portion of the belt member. The nip forming member has an opposed surface along an outer peripheral surface of the pressure roller. The nip forming member presses the belt member to the pressure roller. An end portion of the outer peripheral surface of the pressure roller is located inside with respect to an end portion of the belt member in an axial direction of the rotation. The fixing device further includes a pressing member located opposed to the pressure roller in the axial direction. The pressing member presses an outer peripheral surface of the end portion of the belt member in the axial direction to radially inward of the belt member.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
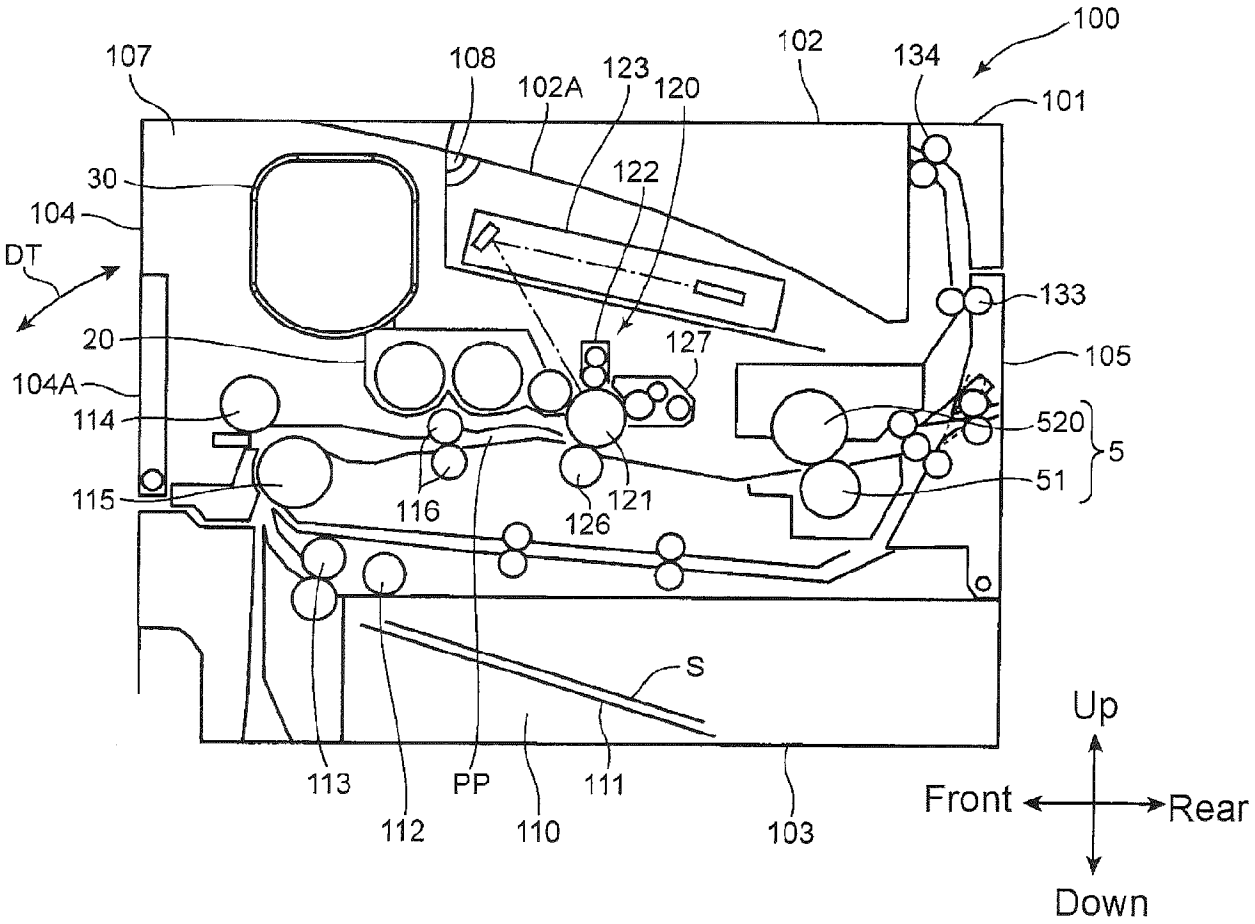
FIG. 1 illustrates a schematic cross section of an internal structure of an image forming apparatus according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes one embodiment of the disclosure by referring to the accompanying drawings. FIG. 1 is a cross section schematically illustrating an internal structure of a printer 100 (an image forming apparatus) according to one embodiment of the disclosure. While the printer 100 as the image forming apparatus illustrated in FIG. 1 is, so-called, a black-and-white printer, the image forming apparatus may be a color printer, a facsimile device, a multi-functional peripheral that includes these functions, and other devices for forming a toner image on a sheet in another embodiment. In the following description, directional terms like "up," "down," "front," "rear," "left," and "right" are simply used for clarifying the description without limiting principles of the image forming apparatus.

The printer 100 includes a housing 101 that houses various units for forming an image on a sheet S. The housing 101 includes an upper wall 102 specifying the top surface of the housing 101, a bottom wall 103 specifying the bottom surface of the housing 101, a main-body rear wall 105 between the upper wall 102 and the bottom wall 103, and a main-body front wall 104 located in front of the main-body rear wall 105. The housing 101 includes a main-body internal space 107 where various kinds of units are located.

In the main-body internal space 107 of the housing 101, a sheet conveyance path PP, which conveys the sheet S in a predetermined conveyance direction, is run.

A paper sheet discharge unit 102A is located in a center of the upper wall 102. The paper sheet discharge unit 102A includes an inclined surface inclining downward from the front portion to the rear portion of the upper wall 102. In the paper sheet discharge unit 102A, the sheet S on which an image is formed in an image forming unit 120, which will be described later, is discharged. A manual bypass tray 104A is located in a center in the vertical direction of the main-body front wall 104. The manual bypass tray 104A is turnable in the vertical direction (an arrow DT in FIG. 1) with the lower end as a fulcrum.

With reference to FIG. 1, the printer 100 includes a sheet feed cassette 110, a pickup roller 112, a first feed roller 113, a second feed roller 114, a conveyance roller 115, a registration roller pair 116, the image forming unit 120, and a fixing device 5.

The sheet feed cassette 110 internally houses the sheet S. The sheet feed cassette 110 includes a lift plate 111. The lift plate 111 is inclined to push up the leading edge of the sheet S. The sheet feed cassette 110 is configured to be extractable forward with respect to the housing 101.

The pickup roller 112 is located on the leading edge of the sheet S, which is pushed up by the lift plate 111. Rotation of the pickup roller 112 extracts the sheet S from the sheet feed cassette 110.

The first feed roller 113 is located in the downstream of the pickup roller 112. The first feed roller 113 further sends out the sheet S downstream. The second feed roller 114 pulls the sheet S on the manual bypass tray 104A inside the housing 101.

The conveyance roller 115 is located in the downstream in a sheet conveyance direction (hereinafter also simply referred to as a conveyance direction) of the first feed roller 113 and the second feed roller 114 (hereinafter also simply referred to as a downstream). The conveyance roller 115 further conveys the sheet S, which is sent out by the first feed roller 113 and the second feed roller 114, downstream.

The registration roller pair 116 has a function of correcting an oblique conveyance of the sheet S. This adjusts a position of an image to be formed on the sheet S. The registration roller pair 116 supplies the sheet S to the image forming unit 120 in accordance with timing of the image formation by the image forming unit 120.

The image forming unit 120 includes a photoreceptor drum 121, a charger 122, an exposure apparatus 123, a developing device 20, a toner container 30, a transfer roller 126, and a cleaning apparatus 127.

The photoreceptor drum 121 has a cylindrical shape. The photoreceptor drum 121 has a surface on which an electrostatic latent image is formed and carries a toner image (a developer image) corresponding to this electrostatic latent image on the surface. The charger 122 applied with a predetermined voltage causes the circumference surface of the photoreceptor drum 121 to be approximately uniformly charged.

The exposure apparatus 123 irradiates the circumference surface of the photoreceptor drum 121 charged by the charger 122 with a laser beam. This laser beam is irradiated in accordance with image data output from an external device (not illustrated) such as a personal computer communicatively connected to the printer 100. This results in forming the electrostatic latent image corresponding to the image data on the circumference surface of the photoreceptor drum 121.

The developing device 20 supplies toner to the circumference surface of the photoreceptor drum 121 on which the electrostatic latent image is formed. The toner container 30 supplies toner to the developing device 20. Supplying the toner to the photoreceptor drum 121 by the developing device 20 develops (visualizes) the electrostatic latent image formed on the circumference surface of the photoreceptor drum 121. This results in forming a toner image (a developer image) on the circumference surface of the photoreceptor drum 121.

The transfer roller 126 is located below the photoreceptor drum 121 opposed to the photoreceptor drum 121 sandwiching the sheet conveyance path PP. The transfer roller 126 forms a transfer nip portion with the photoreceptor drum 121 and causes the toner image to transfer to the sheet S. The cleaning apparatus 127 removes the toner left on the circumference surface of the photoreceptor drum 121 after the toner image has been transferred on the sheet S.

The fixing device 5, which is located downstream with respect to the image forming unit 120 in the conveyance direction, fixes the toner image on the sheet S. Details of the fixing device 5 will be described later.

The printer 100 further includes a conveyance roller pair 133 located downstream of the fixing device 5 and a discharge roller pair 134 located downstream of the conveyance roller pair 133. The sheet S is conveyed upward by the conveyance roller pair 133 and is finally discharged out of the housing 101 by the discharge roller pair 134. The sheet S discharged out of the housing 101 is stacked on the paper sheet discharge unit 102A.

Figure 2:
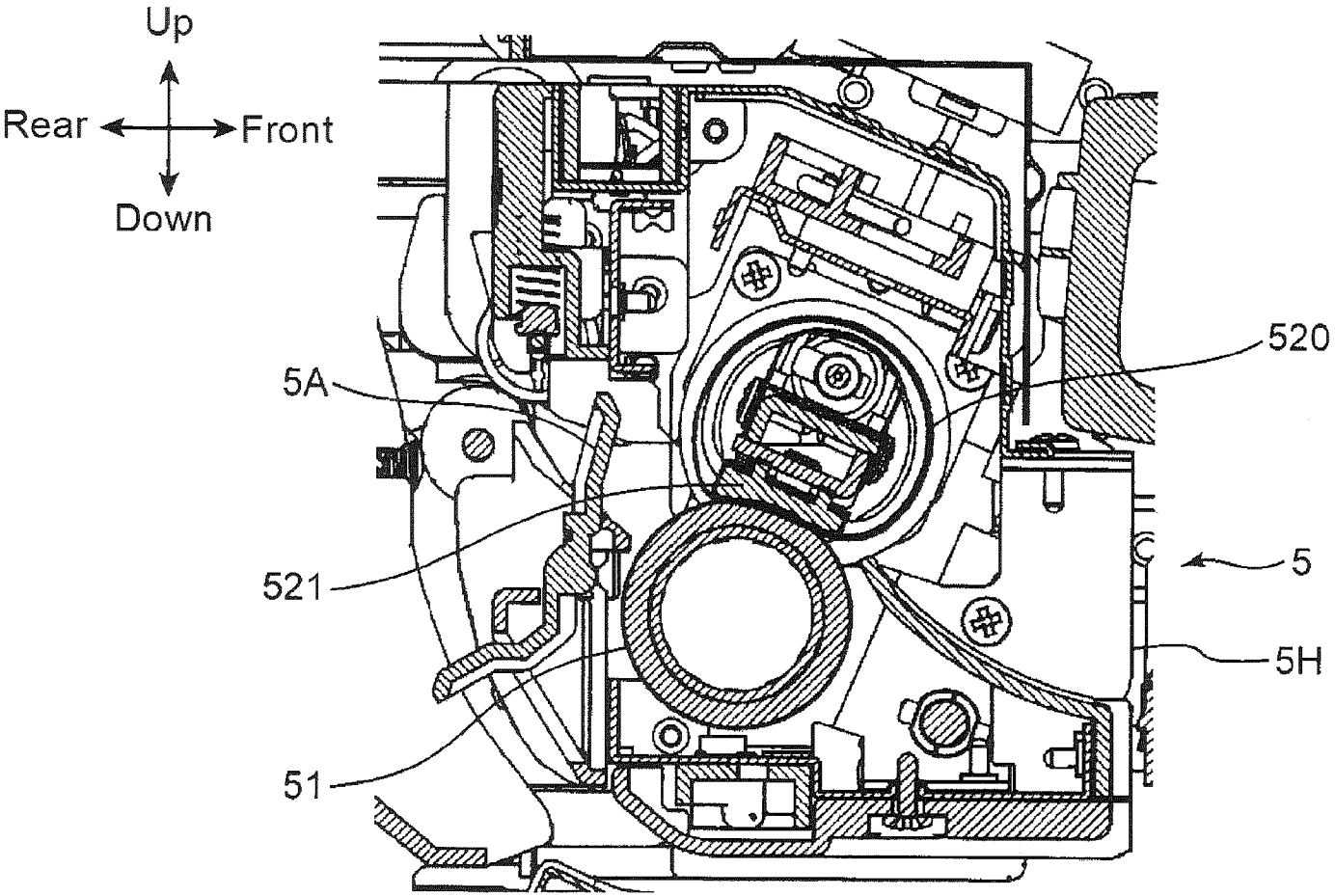
FIG. 2 illustrates a cross section of a fixing device according to the one embodiment.
Figure 3:
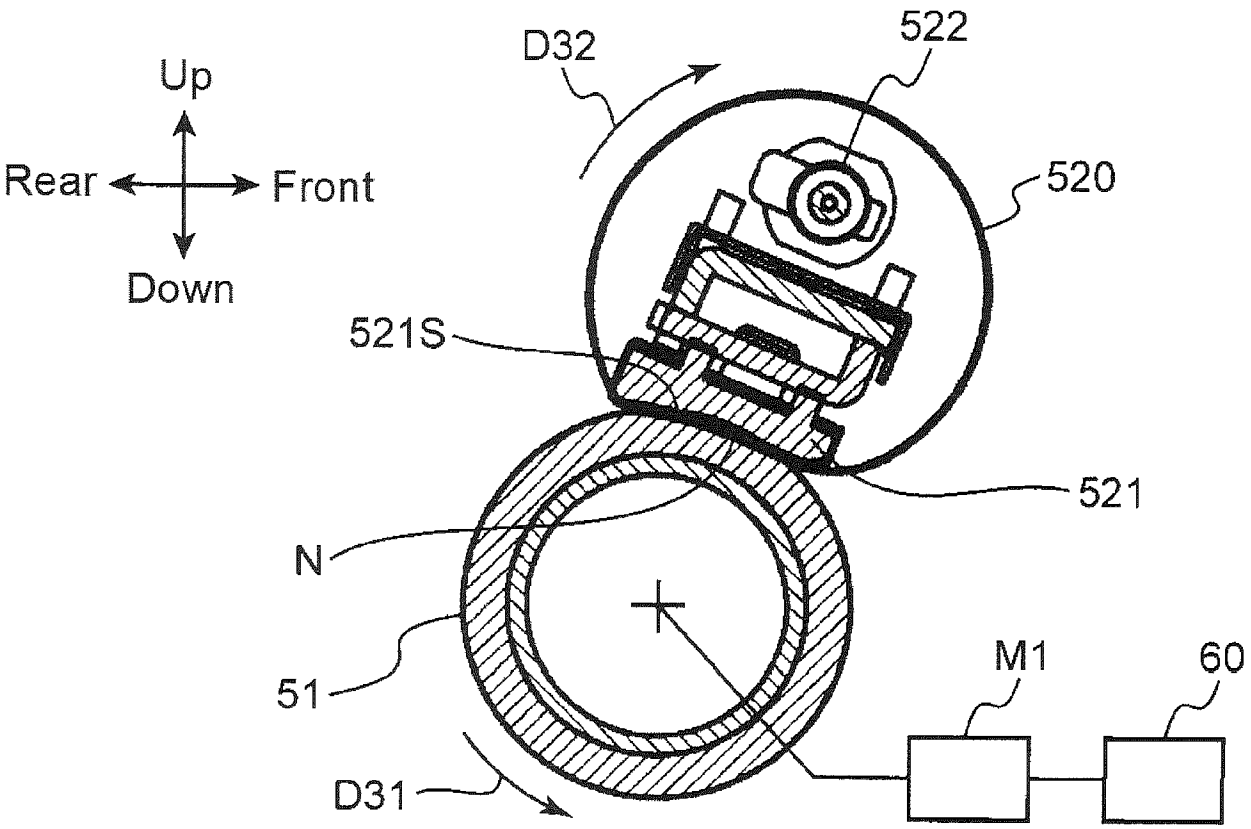
FIG. 3 illustrates a cross section of a belt member and a pressure roller according to the one embodiment.
Figure 4:
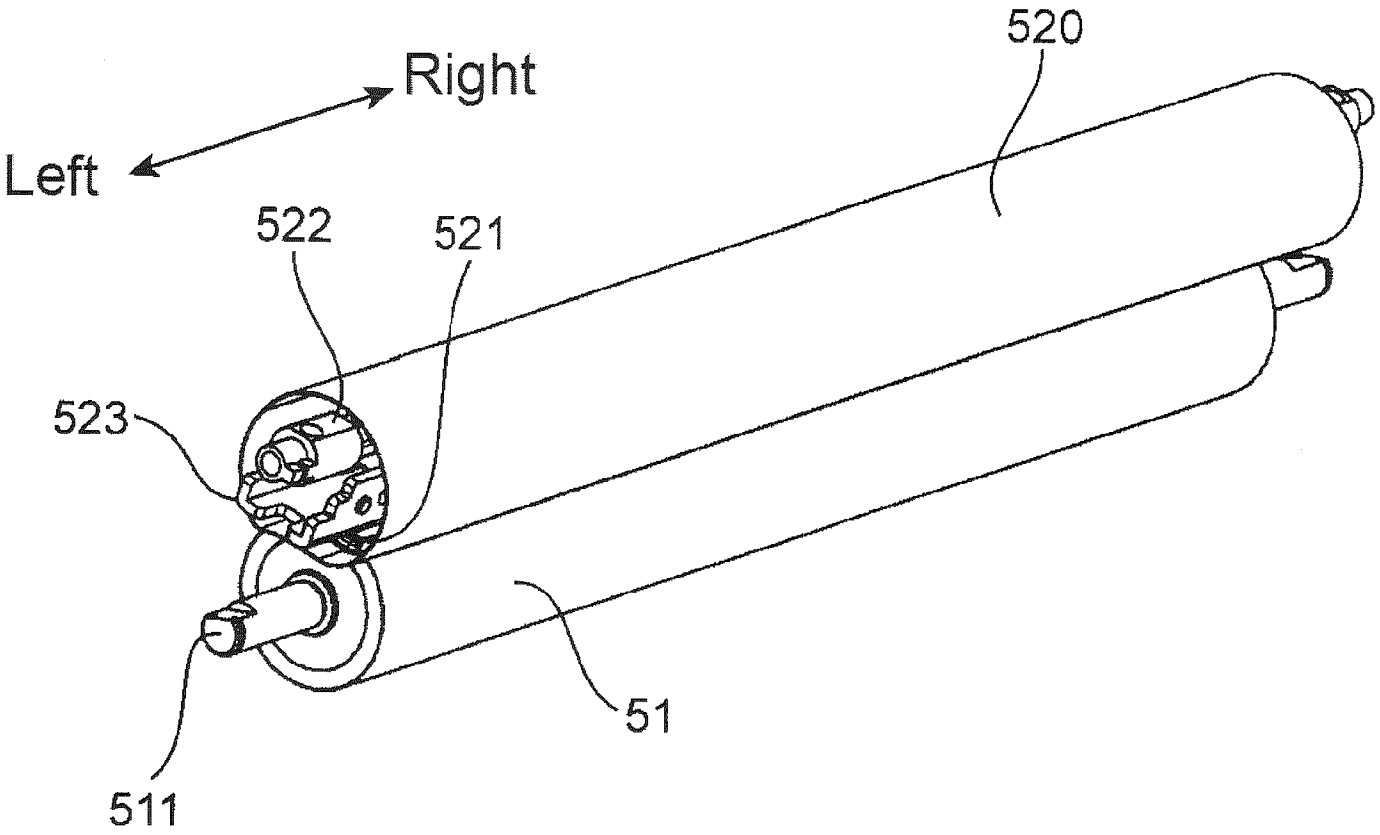
FIG. 4 obliquely illustrates the belt member and the pressure roller according to the one embodiment.
Figure 5:
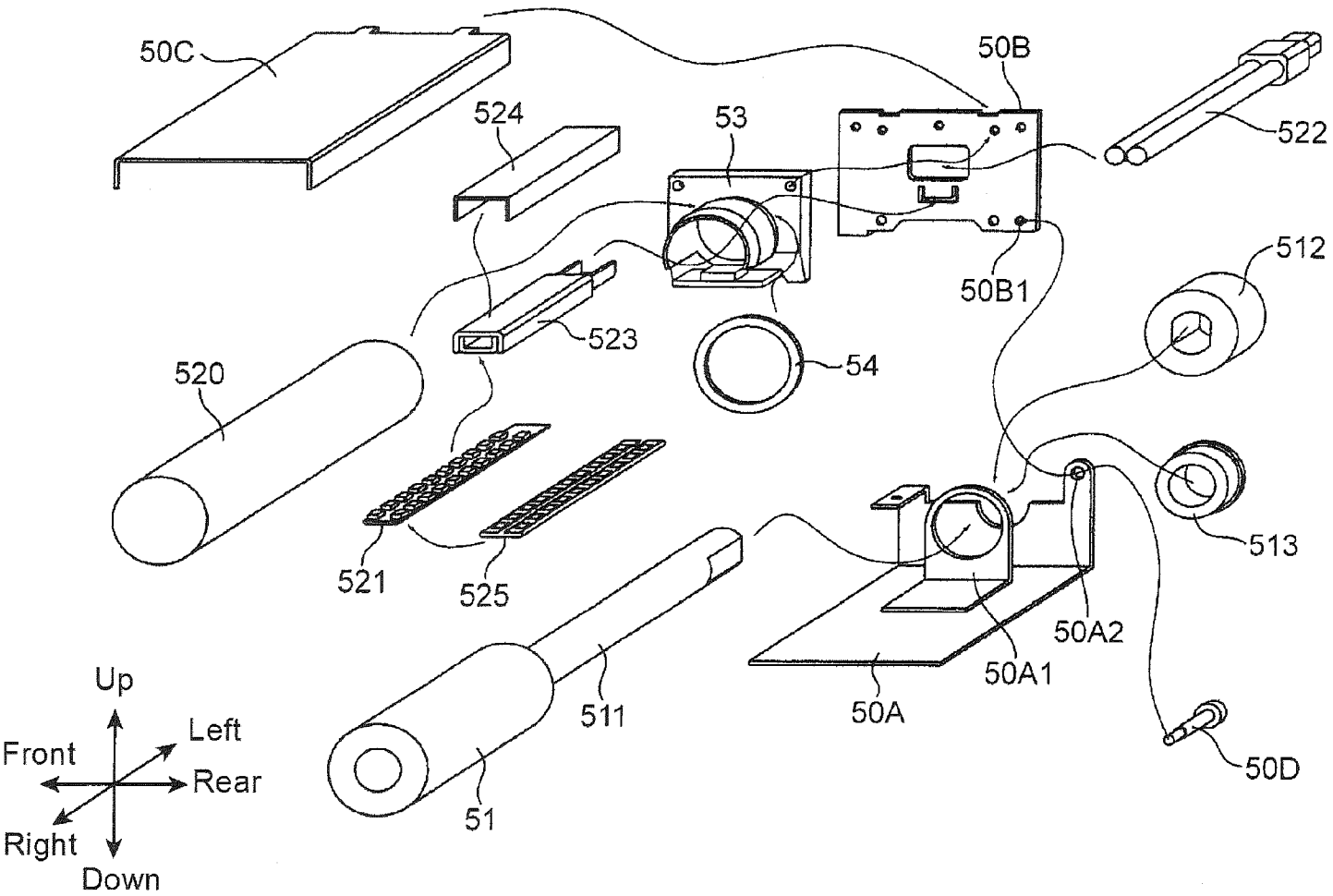
FIG. 5 obliquely illustrates the decomposed fixing device according to the one embodiment.

FIG. 2 illustrates a cross section of the fixing device 5 according to the one embodiment. FIG. 3 illustrates a cross section of a fixing belt 520 and a press roller 51 according to the embodiment. FIG. 4 obliquely illustrates the fixing belt 520 and the press roller 51. FIG. 5 obliquely illustrates the decomposed fixing device 5 according to the embodiment.

With reference to FIG. 2, the fixing device 5 includes a fixing housing 5H (a housing), the fixing belt 520 (the belt member), a nip plate 521 (a nip forming member), and the press roller 51 (the pressure roller).

The fixing housing 5H functions as a housing supporting the respective members of the fixing device 5. The fixing housing 5H has an approximately rectangular parallelepiped shape.

The fixing belt 520 is an endless belt located inside the fixing housing 5H to be rotationally driven. The fixing belt 520 is made of a thin SUS material and formed of a flexible tubular shape. The fixing belt 520 is heated by a halogen heater 522, which will be described later.

The nip plate 521 is located on an inner peripheral portion of the fixing belt 520. The nip plate 521 has a function of abutting on the inner peripheral surface of the fixing belt 520 to press the fixing belt 520 to the press roller 51. The nip plate 521 is made of Liquid Crystal Polymer (LCP) resin. The nip plate 521 includes an opposed surface 521S. The opposed surface 521S is a surface opposed to the press roller 51 in the nip plate 521. The opposed surface 521S has a curved shape along the outer peripheral surface of the press roller 51.

The press roller 51 is located in the fixing housing 5H and has a roller shape. The press roller 51 is rotatably supported to the fixing housing 5H. The press roller 51 is rotationally driven by a motor M1, which will be described later. The press roller 51 forms a fixing nip portion N (FIG. 3) with the fixing belt 520 through which the sheet passes. In this respect, the press roller 51 drives the rotation of the fixing belt 520. The press roller 51 includes a sponge layer on a substrate made of metal. On the surface of the sponge layer, a polytetrafluoroethylene (PFA) tube is further provided.

Additionally, with reference to FIGS. 3 to 5, the fixing device 5 includes the halogen heater 522, a stay 523, a reflective plate 524, a sliding sheet 525, the motor M1 (FIG. 3), and a control unit 60.

The halogen heater 522 is located at an inner peripheral portion of the fixing belt 520 to heat the fixing belt 520. The stay 523 supports the halogen heater 522.

The stay 523 extends in the axial direction of the rotation of the fixing belt 520 inside the cylinder of the fixing belt 520. The stay 523 is formed by welding a plurality of sheet metal members. Both the end portions of the stay 523 are supported to a side plate upper portion 50B (FIG. 5), which will be described later.

The reflective plate 524 is a member made of bright aluminum and is located extending in the axial direction of the fixing belt 520. The reflective plate 524 is positioned between the halogen heater 522 and the stay 523 and is securely supported by the stay 523. The stay 523 reflects the heat from the halogen heater 522 to irradiate the fixing belt 520 with the heat.

The sliding sheet 525 is a tube-shaped member fitted around the nip plate 521. The sliding sheet 525 is made of fluororesin such as PFA. The sliding sheet 525 impregnates oil. The sliding sheet 525 accelerates the rotation of the fixing belt 520 pressed by the nip plate 521.

The motor M1 (FIG. 3) is a motor connected to a roller shaft 511 (FIG. 5) of the press roller 51. The motor M1 generates driving power to rotate the press roller 51. In this respect, the press roller 51 is rotationally driven in a direction of an arrow D31 in FIG. 3. The control unit 60 controls the motor M1. The fixing belt 520, which is brought in contact with the press roller 51, is driven by the press roller 51 to rotate in an arrow D32 direction in FIG. 3.

The control unit 60 controls operations of the respective members in the fixing device 5. Especially, the control unit 60 controls the halogen heater 522 and the motor M1.

Additionally, with reference to FIG. 5, the fixing device 5 includes a side plate lower portion 50A, the side plate upper portion 50B (the side plate), a top panel 50C, a connecting pin 50D, a belt end portion regulating portion 53, a belt end surface receiving member 54 (a ring-shaped member), a drive gear 512, and a bearing 513. FIG. 5 illustrates one end side of the press roller 51 and the fixing belt 520 in the axial direction. The fixing device 5 has a similar configuration also on the other end side in the axial direction.

The side plate lower portion 50A is a frame constituting a part of the fixing housing 5H. The side plate lower portion 50A includes a journal portion 50A1. The journal portion 50A1 supports the roller shaft 511 of the press roller 51 via the bearing 513.

The side plate upper portion 50B is a frame constituting a part of the fixing housing 5H. The side plate lower portion 50A is located at an upper side The side plate upper portion 50B is a frame constituting a part of the fixing housing 5H. The side plate lower portion 50A is located at an lower side of the side plate upper portion 50B. The side plate upper portion 50B is swingable to the side plate lower portion 50A. The side plate upper portion 50B supports the above-described stay 523. The side plate upper portion 50B supports the belt end portion regulating portion 53. The top panel 50C is mounted to the side plate upper portion 50B to cover the upper side of the fixing belt 520.

As illustrated in FIG. 5, the connecting pin 50D is inserted through holes 50A2 and 50B1, which are open at the side plate lower portion 50A and the side plate upper portion 50B, respectively. Accordingly, the side plate upper portion 50B is swingably supported to the side plate lower portion 50A. The swing of the side plate upper portion 50B ensures changing pressing force of the fixing belt 520 against the press roller 51.

The belt end portion regulating portion 53 is secured to the side plate upper portion 50B. The belt end portion regulating portion 53 has a function to hold a posture of the rotating fixing belt 520. Details of the structure of the belt end portion regulating portion 53 will be described later.

The belt end surface receiving member 54 is a ring-shaped member fitted onto an end cap 531 (FIG. 6C) of the belt end portion regulating portion 53. The belt end surface receiving member 54 includes a side surface abutting on an end edge of the fixing belt 520 in the axial direction. The belt end surface receiving member 54 restrains a large movement of the fixing belt 520 in the axial direction.

The drive gear 512 is a rotation gear secured to a distal end portion of the roller shaft 511 (FIG. 5). The drive gear 512 is connected to the motor M1 (FIG. 3) to transmit rotary drive power to the press roller 51.

The bearing 513 is mounted to the journal portion 50A1 of the side plate lower portion 50A. The bearing 513 pivotally supports the roller shaft 511.

Figure 6A:
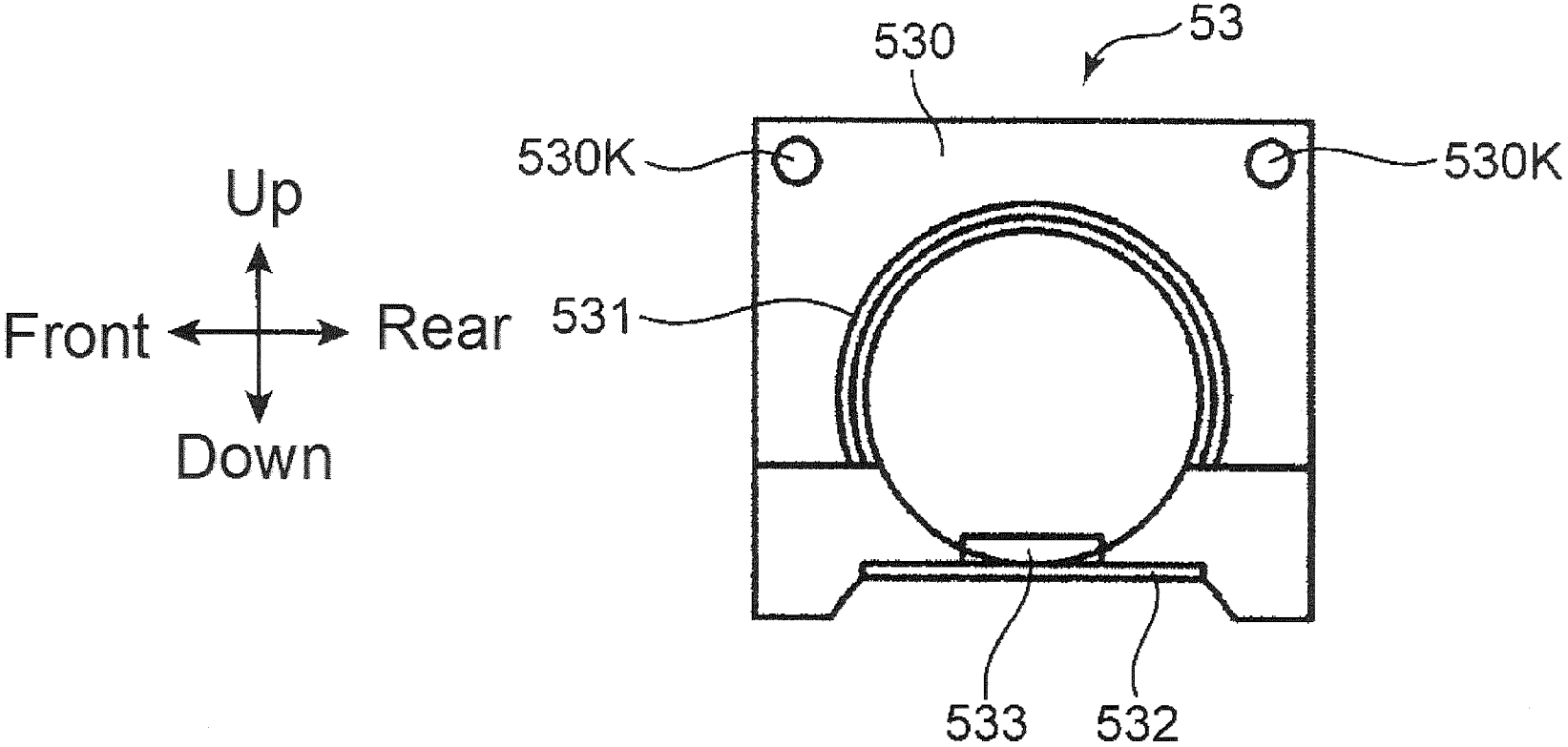
FIG. 6A illustrates a side surface of a belt end portion regulating portion of the fixing device according to the one embodiment.
Figure 6B:
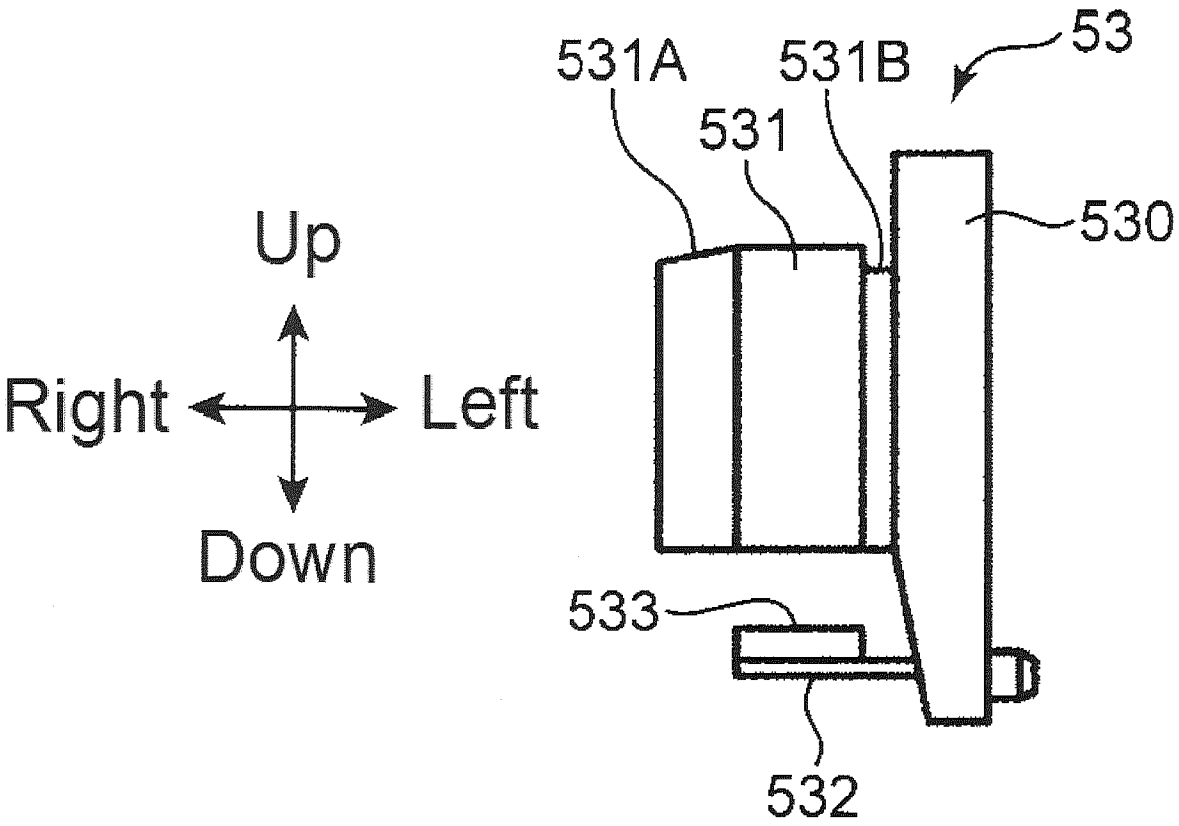
FIG. 6B illustrates a front surface of the belt end portion regulating portion of the fixing device according to the one embodiment.
Figure 6C:
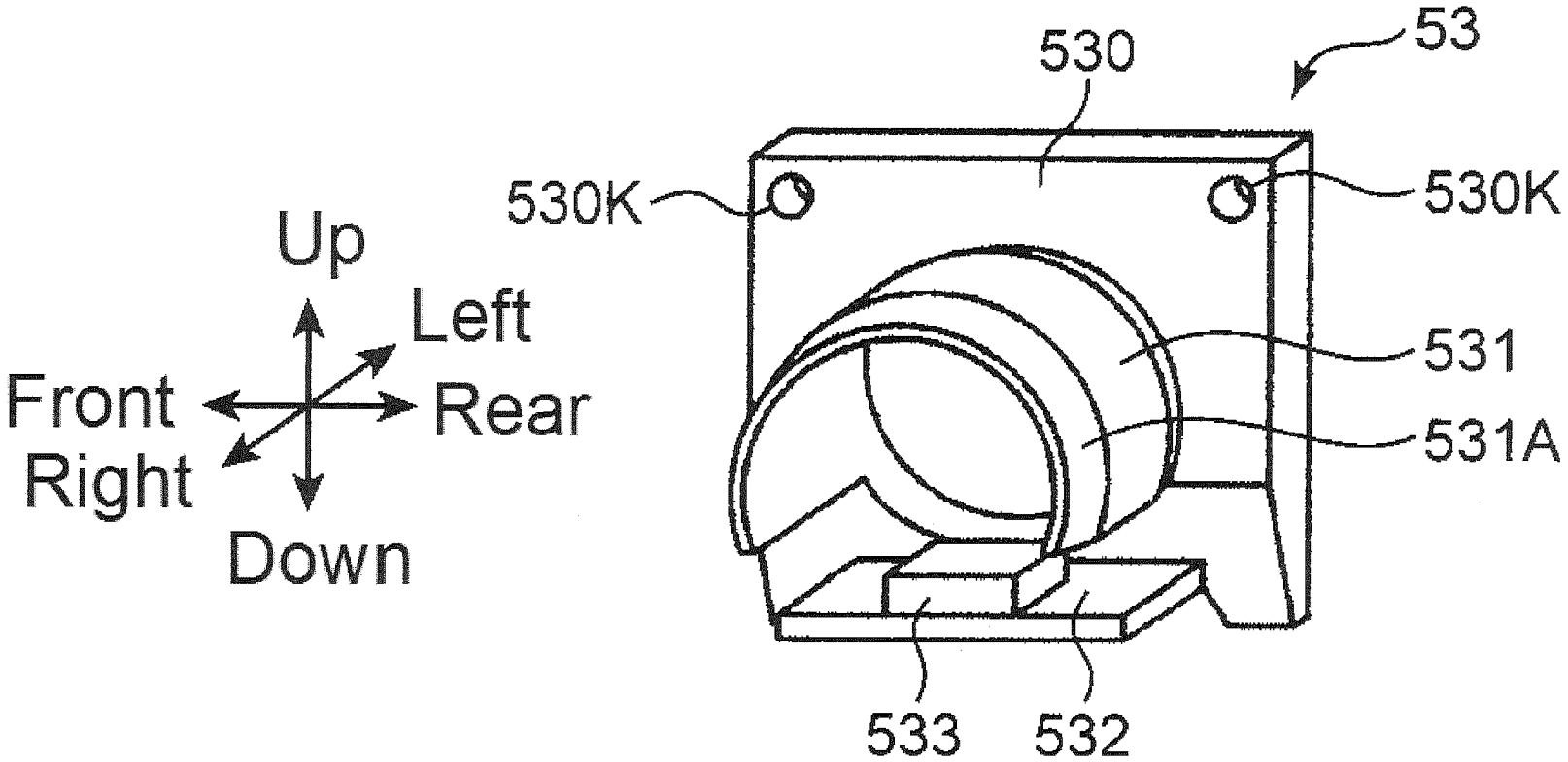
FIG. 6C obliquely illustrates the belt end portion regulating portion of the fixing device according to the one embodiment.

FIGS. 6A, 6B, and 6C illustrate the side surface and the front view, and obliquely illustrate the belt end portion regulating portion 53 of the fixing device according to the embodiment. The belt end portion regulating portion 53 includes a base 530, the end cap 531, a supporting member 532, and a pressing member 533. This embodiment integrally configures the base 530, the end cap 531 (the regulating member), and the supporting member 532.

The base 530 is a main part of the belt end portion regulating portion 53 and is a plate-shaped part located vertically upright. In the side view illustrated in FIG. 6A, the base 530 has an approximately rectangular shape. As illustrated in FIGS. 6A and 6C, on the base 530, a pair of holes 530K are open. An insertion of screws (not illustrated) through these holes and tightening of the screws to the side plate upper portion 50B secure the belt end portion regulating portion 53 to the side plate upper portion 50B (FIG. 5).

The end cap 531 projects from the side surface of the base 530 with an approximately semi-cylinder shape. The end cap 531 is inserted from the end portion of the fixing belt 520 in the axial direction to the tubular-shaped inside of the fixing belt 520. The outer peripheral surface of the end cap 531 abuts on the inner peripheral surface of the fixing belt 520 to regulate a shape of the cross-section (the cross-sectional shape) intersecting with the fixing belt 520 in the axial direction. The end cap 531 includes a taper 531A. The taper 531A is formed by inclination of the distal end portion of the end cap 531 toward the inside in the radial direction of the fixing belt 520. The taper 531A guides the insertion of the end cap 531 to the inner peripheral portion of the fixing belt 520. As illustrated in FIG. 6B, a stepped portion 531B is formed on a base end portion of the end cap 531.

The supporting member 532 is a plate-shaped part located below the end cap 531 and projecting from the side surface of the base 530. In the side view illustrated in FIG. 6A, the supporting member 532 has a width in a front-rear direction approximately identical to an outer diameter of the end cap 531. The supporting member 532 is located on the opposite side from the semi-cylindrical-shaped circumference surface of the end cap 531 sandwiching the fixing belt 520.

The pressing member 533 is a member formed of a thin sheet-shaped rectangular parallelepiped shape secured to the center of the supporting member 532 in the width direction. In this embodiment, the pressing member 533 is made of an elastic material. A release agent is applied over a top surface portion of the pressing member 533. The pressing member 533 has a function to press the outer peripheral surface of the end portion of the fixing belt 520 in the axial direction. The above-described belt end surface receiving member 54 (FIG. 5) is fitted onto the end cap 531 at the left side of the pressing member 533 and the upper side of the supporting member 532 in FIG. 6B.

Figure 7:
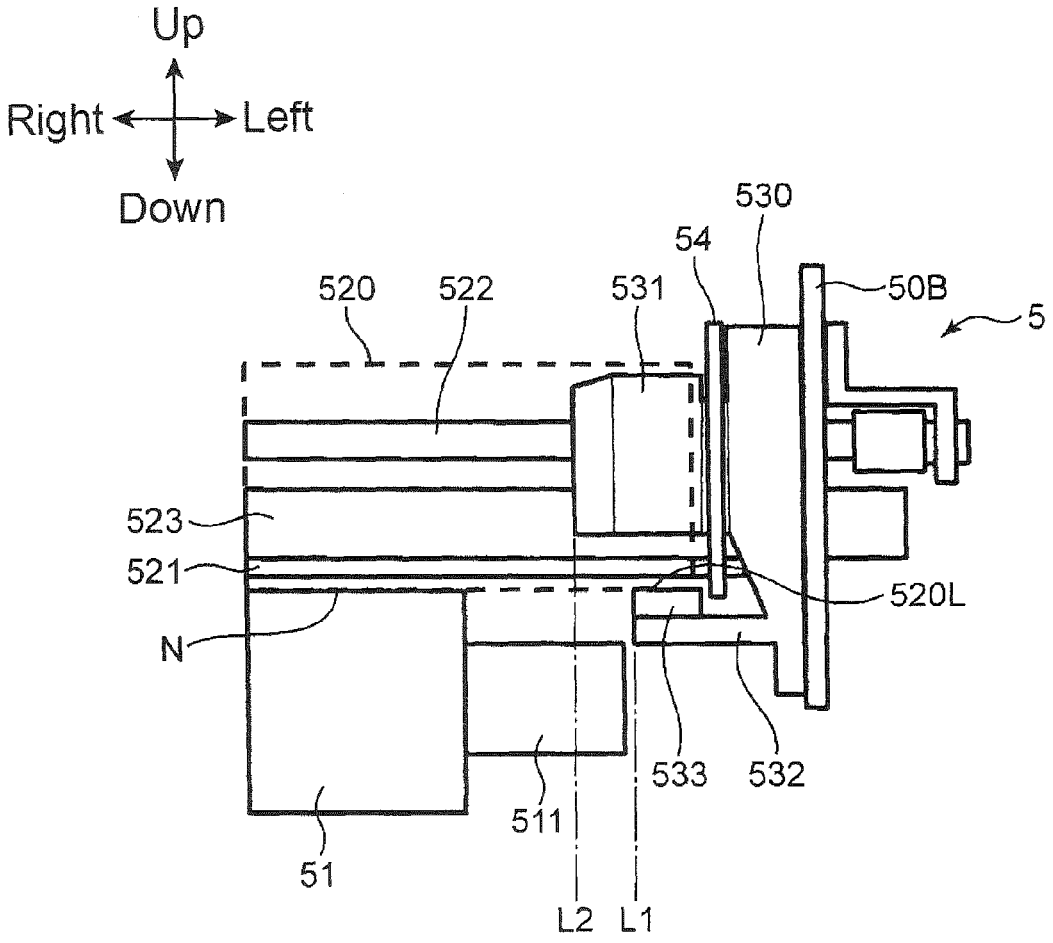
FIG. 7 illustrates a part of a side surface of the fixing device according to the one embodiment.

FIG. 7 illustrates a side surface of a left end side of the fixing device 5 according to the embodiment. Although not illustrated, the right end side of the fixing device 5 also has a similar configuration. As illustrated in FIG. 7, in the axial direction of the rotation of the fixing belt 520, the end portion of the outer peripheral surface of the press roller 51 is located inside with respect to the end portion of the fixing belt 520. The end cap 531 is inserted into the end portion of the fixing belt 520. This stably holds the cross-sectional shape of the fixing belt 520. This ensures a stable passive rotation of the fixing belt 520 to the press roller 51. The end cap 531 passes through the inner peripheral portion of the belt end surface receiving member 54 and then is inserted to the tubular inside of the fixing belt 520. This stably protects the end edge of the fixing belt 520 by the belt end surface receiving member 54 in addition to the posture of the fixing belt 520 being held by the end cap 531.

As illustrated in FIG. 7, the above-described belt end surface receiving member 54 is engaged to the stepped portion 531B of the end cap 531. In view of this, the belt end surface receiving member 54 can axially move by a groove width of the stepped portion 531B. Accordingly, the belt end surface receiving member 54 easily follows the movement of the end edge of the fixing belt 520. Compared with the case where the position of the belt end surface receiving member 54 in the axial direction is secured, this restrains excessively strong regulating force, which regulates the end edge of the fixing belt 520 by the belt end surface receiving member 54. This restrains a damage of the end portion of the fixing belt 520.

Figure 11:
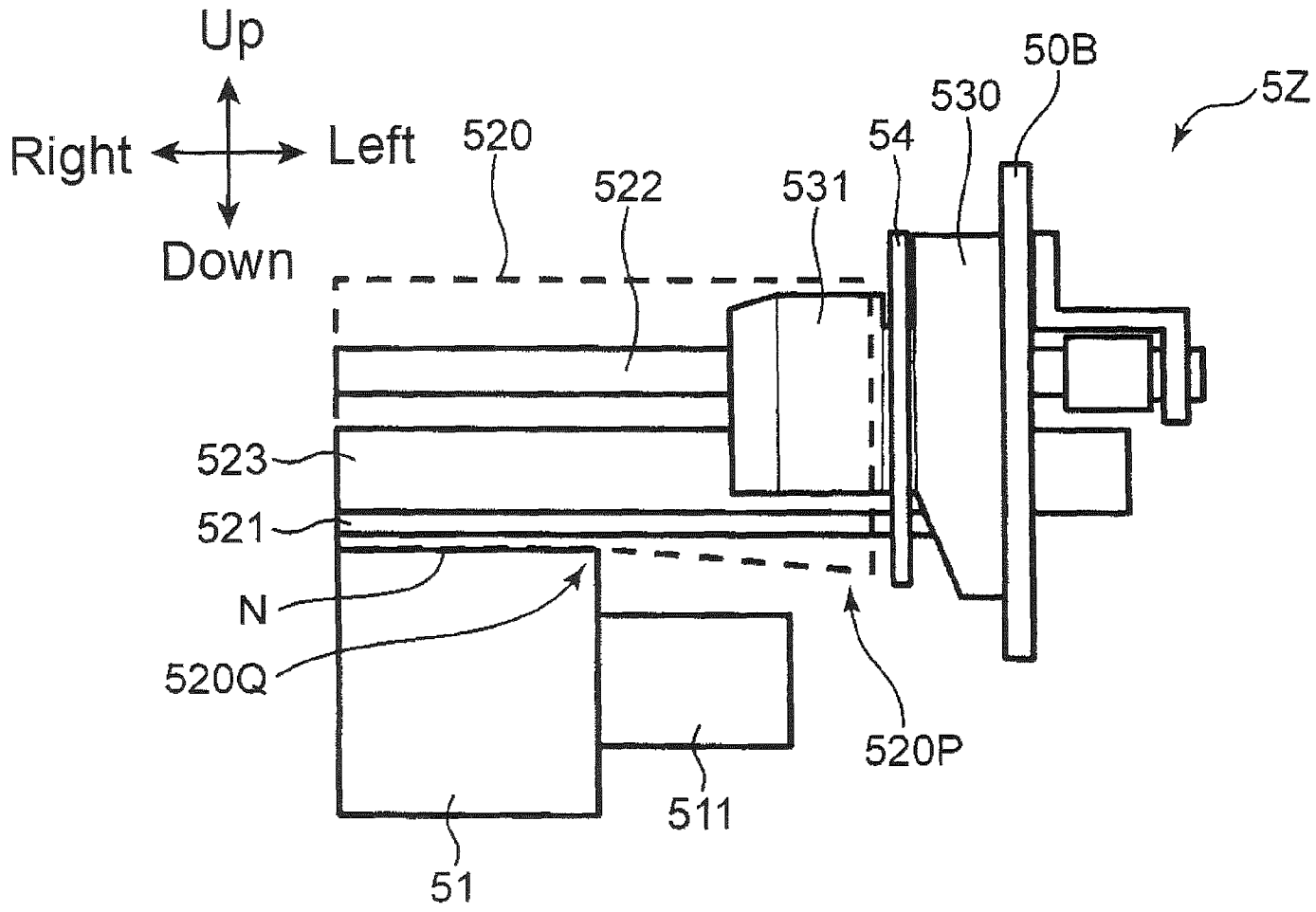
FIG. 11 illustrates a part of a side surface of another fixing device to be compared with the fixing device according to the one embodiment.

FIG. 11 illustrates a side surface of a left end portion of another fixing device 5Z to be compared with the fixing device 5 according to the embodiment. Compared with the fixing device 5, the fixing device 5Z includes neither the supporting member 532 nor the pressing member 533. With reference to FIG. 11, while the fixing belt 520 is pressed by the press roller 51 via the nip plate 521, the press roller 51 is rotationally driven. The press roller 51 drives to rotate the fixing belt 520. In this respect, the lower end side of the fixing belt 520 at the fixing nip portion N is deformed to have a concave shape along the outer peripheral surface of the press roller 51. On the other hand, at the end portion of the fixing belt 520 in the axial direction, the end cap 531 maintains the posture of the fixing belt 520 on the circumferentially opposite side from the fixing nip portion N. Since the outer peripheral surface of the press roller 51 is absent around the end portion of the fixing belt 520, at the lower end portion of the fixing belt 520, a restoring force attempting to return the cross-sectional shape of the fixing belt 520 to the circular shape works. Consequently, a belt end portion 520P projects downward with respect to the fixing nip portion N. A bending portion (a belt bending portion 520Q) is formed on the fixing belt 520 around the end portion of the press roller 51. If the fixing device 5 is kept to be used with this state, starting the belt bending portion 520Q, the fixing belt 520 is likely to cause a friction and a damage.

To solve the problem, the fixing device 5 of this embodiment includes the pressing member 533. With reference to FIG. 7, the pressing member 533 is located axially opposed to the press roller 51. The pressing member 533 presses the outer peripheral surface of the end portion of the fixing belt 520 in the axial direction (a pressed belt portion 520L) toward radially inside (the upper direction of) the fixing belt 520. This restrains axially differentiating the cross-sectional shape of the fixing belt 520. This restrains providing a load partially to the fixing belt 520, restraining a damage of the belt member.

Especially, the pressing member 533 presses the outer peripheral surface of the fixing belt 520 such that the cross-sectional shape of the end portion of the fixing belt 520 goes along the cross-sectional shape of the fixing belt 520 at the fixing nip portion N. Even if the fixing belt 520 is deformed along the outer peripheral surface of the press roller 51 at the fixing nip portion N, this restrains axially differentiating the cross-sectional shape of the fixing belt 520.

In this embodiment, the end cap 531 and the pressing member 533 are located axially outside with respect to the end portion of the outer peripheral surface of the press roller 51. This restrains the posture of the fixing belt 520 around the fixing nip portion N to be excessively corrected by the end cap 531 and the pressing member 533.

The supporting member 532, which supports the pressing member 533, is integrally configured with the end cap 531. Accordingly, the pressing member 533 and the end cap 531 stably maintain the positions of pressing the outer peripheral surface and the inner peripheral surface of the belt member, respectively. The belt end portion regulating portion 53 including the supporting member 532 and the end cap 531 is made of a resin material and integrally molded. This manufactures the supporting member 532 and the end cap 531 at a low price.

In this embodiment, the end cap 531 abuts on the inner peripheral surface of the fixing belt 520 in the predetermined width in the axial direction (the lateral direction). In an abutting region where the end cap 531 abuts on the inner peripheral surface of the fixing belt 520, the pressing member 533 presses the outer peripheral surface of the fixing belt 520 at the outside in the axial direction (the left side) with respect to the inner end portion (the right end portion) in the axial direction. This prevents the pressing member 533 from disturbing the function of the end cap 531 to stabilize the posture of the fixing belt 520. In another embodiment, the pressing member 533 may be run up to a region close to the outer peripheral surface of the press roller 51. However, it is preferable that a distal end portion L1 of the pressing member 533 be located outside in the axial direction with respect to a distal end portion L2 of the end cap 531.

The printer 100, which includes the fixing device 5 according to the embodiments of the disclosure, is described above. The disclosure is not limited to these, and, for example, the following modified embodiments can be employed.

(1) The embodiment describes the aspect where the motor M1 rotates the press roller 51 while the fixing belt 520 is rotatably driven by the press roller 51; however, the disclosure is not limited to this. The motor M1 may directly rotate the fixing belt 520. Above the halogen heater 522, another drive roller that abuts on the inner peripheral surface of the fixing belt 520 may be located, and this drive roller may be rotatably driven by the motor M1 to rotationally drive the fixing belt 520.

(2) The embodiment describes the aspect where the release agent is applied over the top surface portion of the pressing member 533; however, the disclosure is not limited to this. In another modified embodiment, there may be an aspect where a low friction material and a fiber material are provided over the top surface portion of the pressing member 533. In this case as well, a load of the pressing member 533 pressing the outer peripheral surface of the fixing belt 520 can be reduced. This also ensures reducing a friction at the fixing belt 520.

Figure 8:
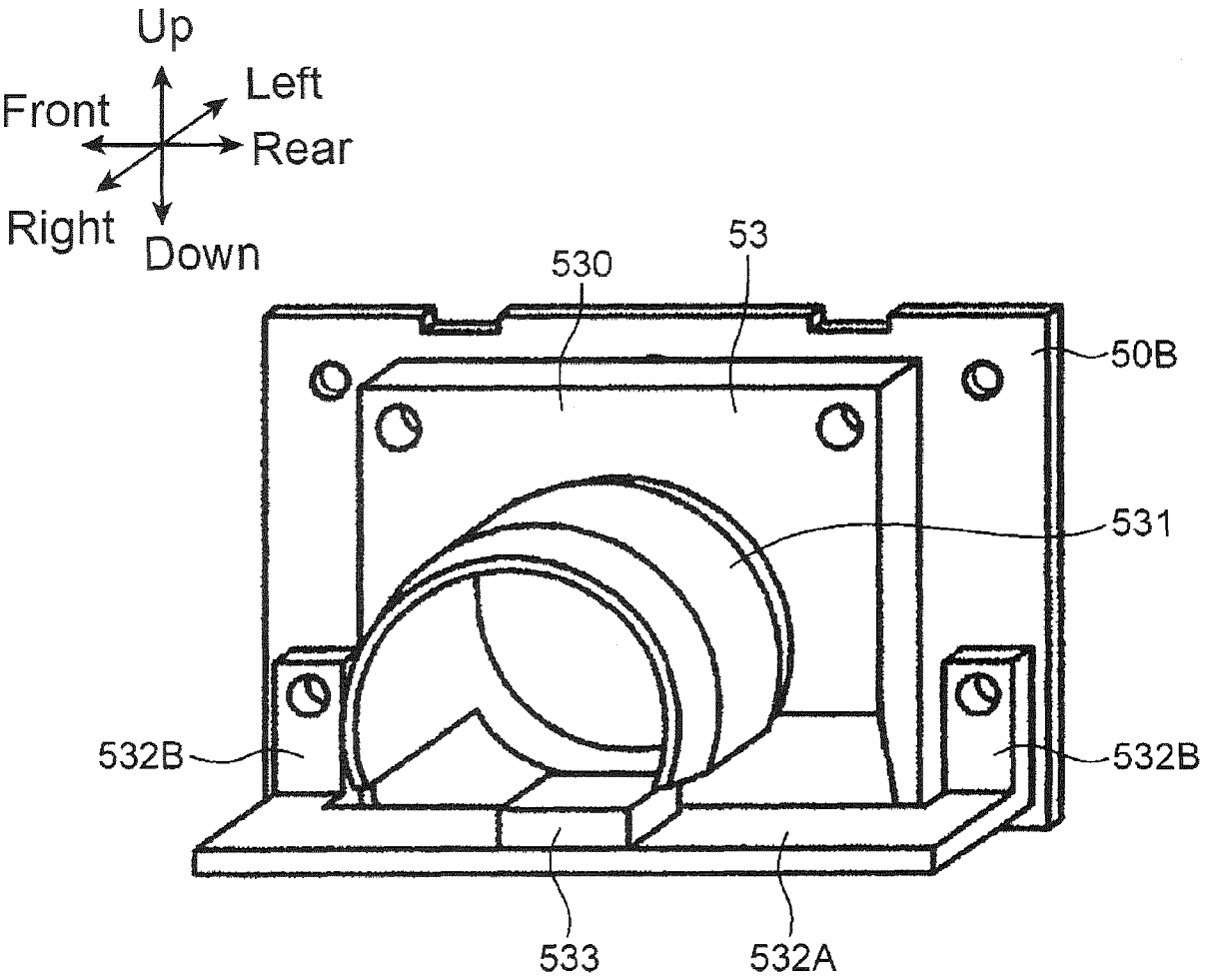
FIG. 8 obliquely illustrates surroundings of a belt end portion regulating portion of a fixing device according to a modified embodiment.
Figure 9:
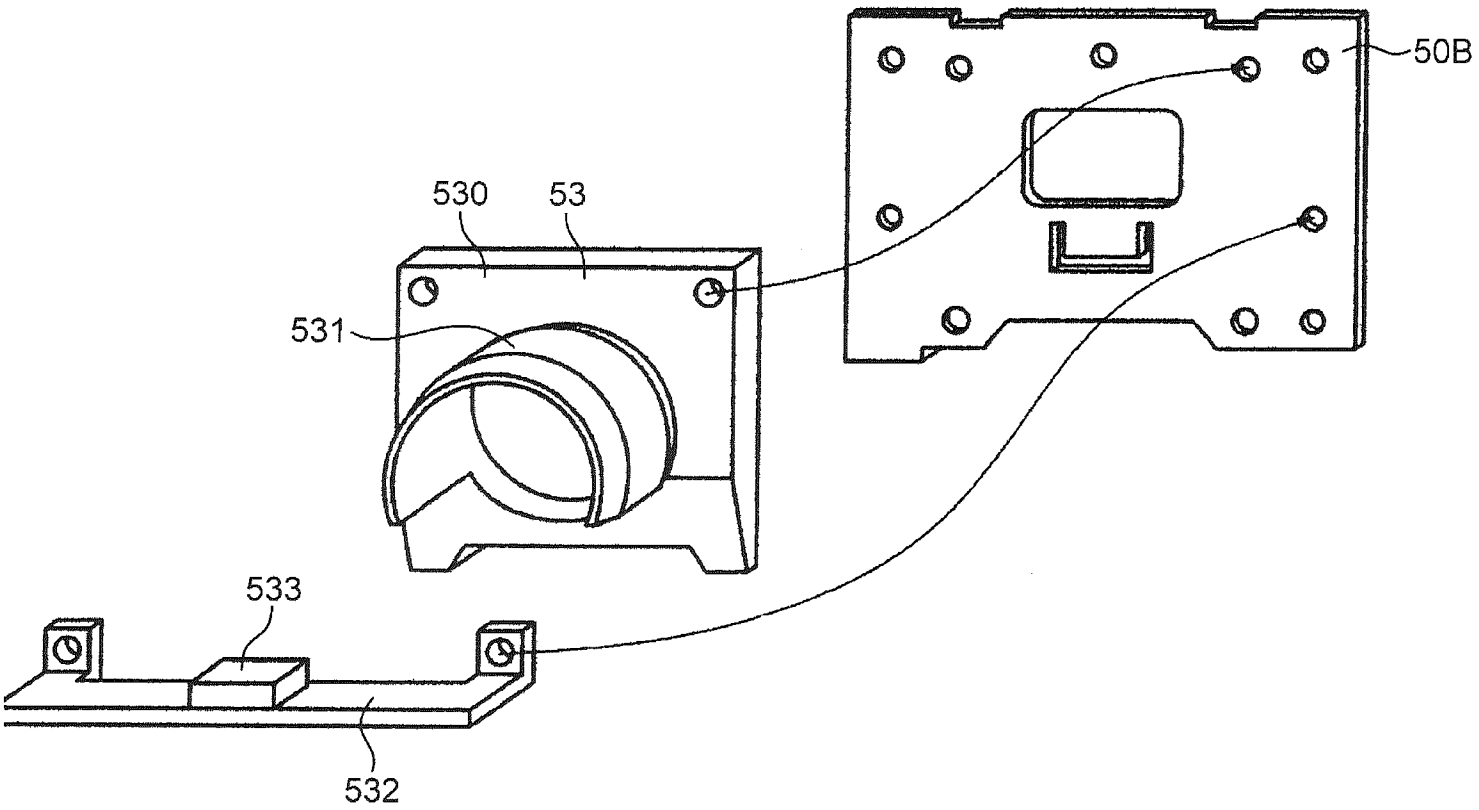
FIG. 9 obliquely illustrates surroundings of the decomposed belt end portion regulating portion of the fixing device according to the modified embodiment.

(3) The embodiment describes the aspect where the end cap 531 and the supporting member 532 are integratedly configured as the belt end portion regulating portion 53; however, the disclosure is not limited to this. FIGS. 8 and 9 obliquely illustrate surroundings of the belt end portion regulating portion 53 of the fixing device according to the modified embodiment and the decomposed surroundings of the belt end portion regulating portion. Compared with the previous embodiment, the modified embodiment differs in structures of the supporting member 532 and the pressing member 533. Therefore, only these differences are described, and the following omits descriptions on the other common points. With reference to FIGS. 8 and 9, the belt end portion regulating portion 53 includes the base 530 and the end cap 531. The belt end portion regulating portion 53 is supported by the side plate upper portion 50B (the side plate).

The supporting member 532 is formed of a member different from the belt end portion regulating portion 53 and is supported to the side plate upper portion 50B. In details, the supporting member 532 includes a supporting member 532A, which extends horizontally, and a pair of fixed portions 532B, which are located upright from both the end portions of the supporting member 532A. The pair of fixed portions 532B are tightened to the side plate upper portion 50B with screws (not illustrated). Similar to the previous embodiment, the supporting member 532 supports the pressing member 533.

Thus, the supporting member 532 supporting the pressing member 533 may be formed of the member different from the belt end portion regulating portion 53. In this case, changing the shape of the supporting member 532 ensures easily adjusting the position at which the pressing member 533 presses the outer peripheral surface of the fixing belt 520. In the modified embodiment and the previous embodiment, the supporting member 532 is located spaced under (namely, outside in a radial direction) the belt end surface receiving member 54 (see FIG. 7). This configuration causes the pressing member 533 to abut on the fixing belt 520 and the supporting member 532 does not regulate behaviors of the belt end surface receiving member 54. This secures a degree of freedom of movement of the belt end surface receiving member 54, ensuring stably regulating the position of the end edge of the fixing belt 520 by the belt end surface receiving member 54. The end edge of the fixing belt 520 is stably protected by the belt end surface receiving member 54.

Figure 10:
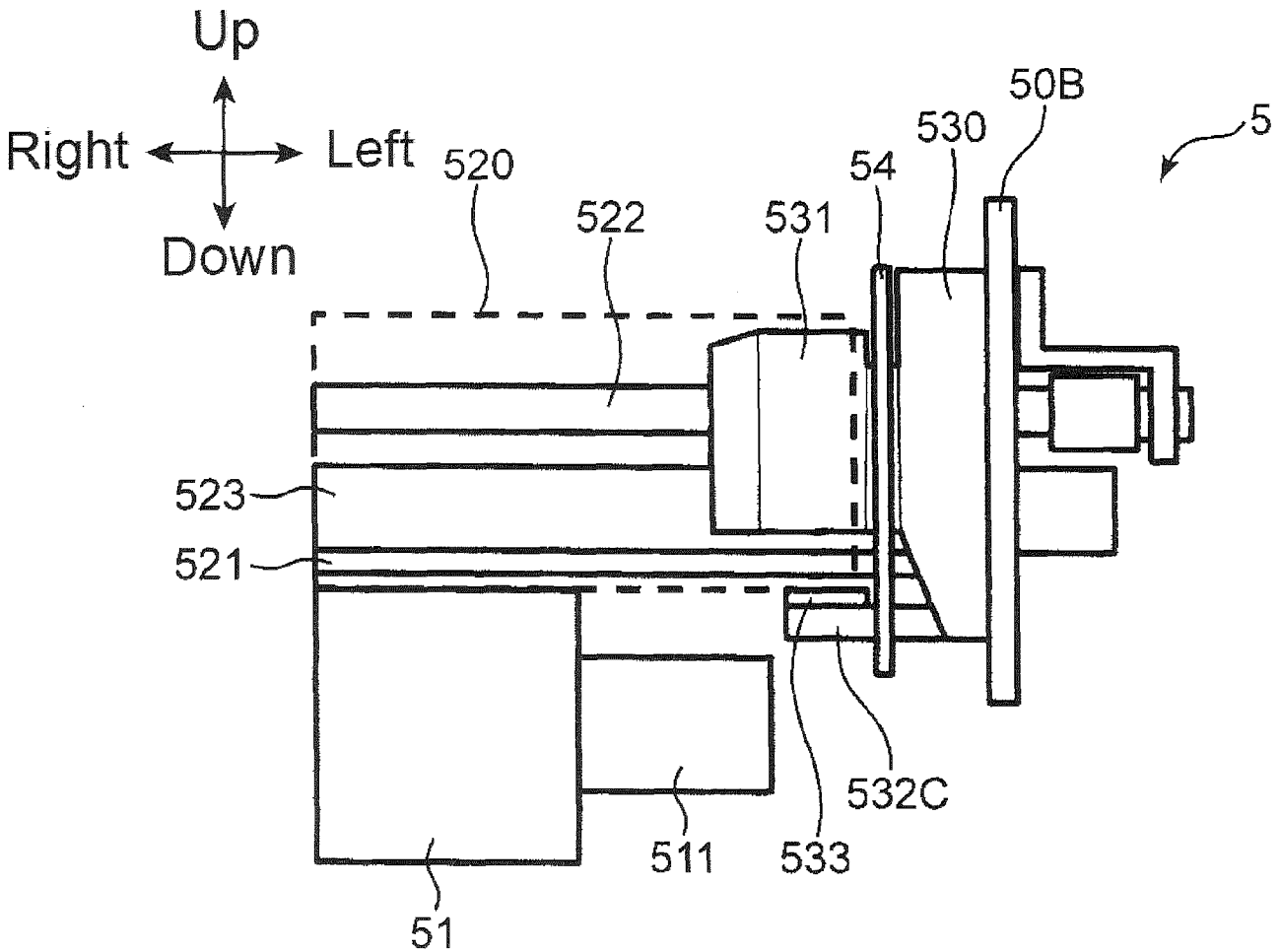
FIG. 10 illustrates a part of a side surface of the fixing device according to the modified embodiment.

(4) The embodiment describes the aspect where the supporting member 532 is located spaced under the belt end surface receiving member 54 (FIG. 7); however, the disclosure is not limited to this. FIG. 10 illustrates a side surface of the left end portion of the fixing device according to another modified embodiment. Compared with the previous embodiment, the modified embodiment differs in that a supporting member 532C is provided. Therefore, only these differences are described, and the following omits descriptions on the other common points. With reference to FIG. 10, the fixing device includes the supporting member 532C secured to the base 530. The supporting member 532C passes through the ring-shaped inner peripheral portion of the belt end surface receiving member 54 and is opposed to the outer peripheral surface of the fixing belt 520. Similar to the previous embodiment, the supporting member 532C supports the pressing member 533. The pressing member 533 presses the outer peripheral surface of the end portion of the fixing belt 520 in the axial direction upward.

Thus, the configuration where the supporting member 532C is inserted through the inner peripheral portion of the belt end surface receiving member 54 also holds the cross-sectional shape of the fixing belt 520 to be approximately constant along the axial direction by the pressing member 533. The end edge of the fixing belt 520 is stably protected by the belt end surface receiving member 54.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A fixing device comprising:

a housing;

a belt member constituted of a flexible tubular shape;

a pressure roller rotated and pressed by the belt member, the pressure roller forming a fixing nip portion with the belt member, a sheet passing through the fixing nip portion; and a nip forming member located at an inner peripheral portion of the belt member, the nip forming member having an opposed surface along an outer peripheral surface of the pressure roller, the nip forming member pressing the belt member to the pressure roller, the fixing device further comprising:

a rotatable ring-shaped member that has a side surface abutting on an end edge of the belt member in the axial direction; and a supporting member that passes through the inner peripheral portion of the ring-shaped member and is located opposed to the outer peripheral surface of the belt member, the supporting member supporting the pressing member, wherein an end portion of the outer peripheral surface of the pressure roller is located inside with respect to an end portion of the belt member in an axial direction of the rotation, and the fixing device further includes a pressing member located opposed to the pressure roller in the axial direction, the pressing member pressing an outer peripheral surface of the end portion of the belt member in the axial direction to radially inward of the belt member, the pressing member presses the outer peripheral surface of the belt member such that a cross-sectional shape of the end portion of the belt member in the axial direction intersecting with the axial direction goes along the cross-sectional shape of the belt member at the fixing nip portion, the belt member is rotatably driven by the pressure roller, the fixing device further includes a regulating member inserted from the end portion of the belt member in the axial direction into the tubular-shape, the regulating member abutting on an inner peripheral surface of the belt member to regulate the cross-sectional shape of the belt member, and the regulating member passes through an inner peripheral portion of the ring-shaped member and is inserted into the tubular-shape of the belt-shaped member.

2. The fixing device according to claim 1, wherein the regulating member and the pressing member are located outside in the axial direction with respect to the end portion of the outer peripheral surface of the pressure roller.

3. The fixing device according to claim 2, wherein the regulating member abuts on the inner peripheral surface of the belt member in a predetermined width in the axial direction, and the pressing member presses the outer peripheral surface of the belt member, at an outside in the axial direction with respect to an inner end portion in the axial direction in an abutting region where the regulating member abuts on the inner peripheral surface.

4. The fixing device according to claim 1, wherein the pressing member is integrated with the regulating member.

5. The fixing device according to claim 1, further comprising:

a side plate that supports the regulating member; and a supporting member supported by the side plate, the supporting member supporting the pressing member.

6. The fixing device according to claim 1, further comprising a supporting member located outside the ring-shaped member in a radial direction, the supporting member supporting the pressing member.

7. The fixing device according to claim 1, wherein the pressing member has an abutting surface abutting on the outer peripheral surface of the belt member, a low friction material or a fiber material is provided on the abutting surface.

8. An image forming apparatus comprising:

an image forming unit that forms an image on a sheet; and the fixing device according to claim 1.

* * * * *